US010309046B2

(12) United States Patent
Konno

(10) Patent No.: US 10,309,046 B2
(45) Date of Patent: Jun. 4, 2019

(54) SEAM STRUCTURE FOR FABRIC

(71) Applicant: pro best Co., Ltd., Tokyo (JP)

(72) Inventor: Hiroki Konno, Tokyo (JP)

(73) Assignee: pro best Co., Ltd., Tokyo (JP)

( * ) Notice: Subject to any disclaimer, the term of this patent is extended or adjusted under 35 U.S.C. 154(b) by 723 days.

(21) Appl. No.: 14/781,532

(22) PCT Filed: Apr. 2, 2014

(86) PCT No.: PCT/JP2014/059708
§ 371 (c)(1),
(2) Date: Sep. 30, 2015

(87) PCT Pub. No.: WO2014/163102
PCT Pub. Date: Oct. 9, 2014

(65) Prior Publication Data

US 2016/0024700 A1 Jan. 28, 2016

(30) Foreign Application Priority Data

Apr. 4, 2013 (JP) ..... 2013-078563

(51) Int. Cl.
*D05B 1/22* (2006.01)
*D05B 93/00* (2006.01)
(Continued)

(52) U.S. Cl.
CPC ..... *D05B 1/22* (2013.01); *B32B 7/08* (2013.01); *D05B 1/20* (2013.01); *D05B 93/00* (2013.01)

(58) Field of Classification Search
CPC ..... D05B 1/20; D05B 1/22; D05B 93/00
(Continued)

(56) References Cited

U.S. PATENT DOCUMENTS 3,079,882 A * 3/1963 Washburn ..... D05B 1/20 112/260
3,246,621 A * 4/1966 Copeland ..... A41D 27/24 112/413

(Continued)

FOREIGN PATENT DOCUMENTS

JP 01299585 12/1989
JP 02252489 10/1990

(Continued)

OTHER PUBLICATIONS

International Search Report dated Oct. 6, 2015 filed in PCT/JP2014/059708.

(Continued)

*Primary Examiner* — Nathan E Durham
(74) *Attorney, Agent, or Firm* — Rankin, Hill & Clark LLP

(57) ABSTRACT

The invention provides a seam structure for fabric and a sewing method which are aesthetically superior and by which pieces of fabric can be sewn together smoothly, without a sewn-on portion protruding at the reverse surface of a garment that comes in contact with the skin, and without fabric edges being exposed at the front surface of the garment.

On the upper face of one piece of fabric 2, there extends, along an edge 2*a* of the fabric, a stitch 5 that is formed as a result of a part of a needle thread 6 passing through the fabric to reach a lower face thereof through stitch holes 4 that are provided at regular intervals; on an upper face of another piece of fabric 3, there are arrayed, along an edge 3*a* of the fabric, a plurality of rings 7 that are formed as a result of protrusion of an annular leading end of the needle thread 6 having passed through the stitch holes 4 of the one piece of fabric 2 and through the lower faces of the two pieces of fabric; and a first looper thread 8, which runs in a zigzagging (Continued)

manner on the fabric upper faces towards the other piece of fabric 3 so as to entwine two needle threads that pass through the stitch holes 4 of the one piece of fabric 2, and the rings 7 that protrude beyond the other piece of fabric 3, are linked by a second looper thread 9, to yield a seam structure for fabric in which the two pieces of fabric are joined in a state where respective edges thereof are connected to each other.

1 Claim, 11 Drawing Sheets

(51) Int. Cl.
*B32B 7/08* (2019.01)
*D05B 1/20* (2006.01)

(58) Field of Classification Search
USPC ..... 112/423, 440, 441
See application file for complete search history.

(56) References Cited

U.S. PATENT DOCUMENTS 4,117,792 A * 10/1978 Navlyt ..... D05B 93/00 112/433
4,175,499 A * 11/1979 Navlyt ..... D05B 93/00 112/165
4,580,514 A * 4/1986 Hanyu ..... D05B 1/20 112/162
4,690,080 A * 9/1987 Mikuni ..... D05B 57/34 112/162
4,875,423 A * 10/1989 Conti ..... D05B 1/20 112/438
5,237,942 A * 8/1993 Satoma ..... D05B 57/06 112/162
5,381,745 A * 1/1995 Nolle ..... D05B 1/10 112/255
5,465,674 A * 11/1995 Gosche ..... D05B 57/06 112/162
5,934,211 A * 8/1999 Sakuma ..... D05B 45/00 112/255
2007/0056491 A1* 3/2007 Yasuzawa ..... D05B 1/08 112/197
2009/0151397 A1* 6/2009 Sturman ..... A41D 27/24 66/178 A
2015/0167218 A1* 6/2015 Sakuma ..... D05B 63/00 112/302

FOREIGN PATENT DOCUMENTS

JP 06134163 5/1994
JP 08141233 6/1996
JP 2007169812 A2 7/2007

OTHER PUBLICATIONS

Japanese Office Action dated May 12, 2015 issued in the corresponding Japanese patent application No. 2014-557896 and English translation thereof.

* cited by examiner (a)

(b)

(a)

(b)

(a)

(b)

(a)

(b)

(a)

(b)

SEAM STRUCTURE FOR FABRIC

TECHNICAL FIELD

The present invention relates to a seam structure for fabric and to a sewing method for mutually joining edges of two pieces of fabric in a state where respective edges thereof are connected to each other.

BACKGROUND ART

In order to conventionally sew together two pieces of fabric, for instance in garment sewing, overlock sewing machines are ordinarily used to join the two pieces of fabric while avoiding fraying of fibers at the edges of the pieces of fabric. Generally, two superposed pieces of fabric, with the edges thereof aligned, are over-edge stitched at the edges, using two looper threads, while the pieces of fabric are sewn together using a needle thread (FIG. 11(*a*)). The appearance of the sewn-on portion resulting from such sewing by the overlock sewing machine is poor in that, although fibers are not frayed, the edges of the pieces of fabric are nevertheless still exposed. In consequence, the sewn-on portion is made non-visible from the outside by being arranged on the reverse surface of the garment.

When the sewn-on portion resulting from such sewing by the overlock sewing machine is disposed on the reverse surface of the garment, however, the fabric becomes thicker at the sewn-on portion (FIGS. 11(*a*), 11(*b*)), and the sewn-on portion protrudes beyond the reverse surface of the garment, thereby irritating the skin. In particular, allergic diseases of the skin, for instance atopic dermatitis, have become problematic in recent years. When the skin comes in contact with a garment, the symptoms of such diseases are aggravated due to itching induced by rubbing with the garment. Some improvement can be achieved by turning inside out the underwear or garment that is in contact with the skin, but, even if the protruding sewn-on portion does not come directly in contact with the skin, the sewn-on portion of thick fabric, although lying on the outer surface of the garment, exerts however greater pressure on the skin than other portions of the garment, and the skin becomes irritated, due to sliding, when the individual moves. Wearing the underwear or garment turned inside out is not only troublesome and unaesthetic, but makes it also difficult to fully bring out the intrinsic functionality of such high-functional fabrics as have been developed in recent years, all of which detracts from the value of the garment.

Accordingly, a demand exists for a seam structure for fabric and a sewing method that are aesthetically superior and by virtue of which pieces of fabric can be sewn together smoothly, without a sewn-on portion protruding at the reverse surface of a garment that comes in contact with the skin, and without fabric edges being exposed at the front surface of the garment.

Patent literature 1: Japanese Patent Application Publication No. 2013-34668

DISCLOSURE OF THE INVENTION

It is an object of the present invention to provide a seam structure for fabric and a sewing method that are aesthetically superior and by virtue of which pieces of fabric can be sewn together smoothly, without a sewn-on portion protruding at the reverse surface of a garment that comes in contact with the skin, and without fabric edges being exposed at the front surface of the garment.

As a result of studies directed at solving the above problems, the inventor found that the ends of two pieces of fabric can be joined, without protrusion of a sewn-on portion, by virtue of a feature, wherein on the upper face of one piece of fabric, there extends, along an edge of the fabric, a stitch that is formed as a result of part of a needle thread passing through the fabric to reach a lower face thereof through stitch holes that are provided at regular intervals; on the upper face of the other piece of fabric, there are arrayed, along an edge of the fabric, a plurality of rings that are formed as a result of protrusion of an annular leading end of the needle thread that has passed through the stitch holes of the one piece of fabric and through the lower faces of the two pieces of fabric; and a first looper thread, which runs in a zigzagging manner on the fabric upper faces towards the other piece of fabric so as to entwine two needle threads that pass through the stitch holes of the one piece of fabric, and the rings that protrude beyond the other piece of fabric, are linked as a result of a second looper thread repeatedly entering each loop hole that is formed by the first looper thread, and exiting the loop hole while entwining two opposing threads of two adjacent rings that protrude beyond the other piece of fabric, and then entering a neighboring loop hole formed by the first looper thread; and perfected the present invention on the basis of the above finding.

Specifically, the present invention is a seam structure for fabric, which is a structure for joining two pieces of fabric, wherein on the upper face of one piece of fabric, there extends, along an edge of the fabric, a stitch that is formed as a result of part of a needle thread passing through the fabric to reach a lower face thereof through stitch holes that are provided at regular intervals; on the upper face of the other piece of fabric, there are arrayed, along an edge of the fabric, a plurality of rings that are formed as a result of protrusion of an annular leading end of the needle thread that has passed through the stitch holes of the one piece of fabric and through the lower faces of the two pieces of fabric; and a first looper thread, which runs in a zigzagging manner on the fabric upper faces towards the other piece of fabric so as to entwine two needle threads that pass through the stitch holes of the one piece of fabric, and the rings that protrude beyond the other piece of fabric, are linked as a result of a second looper thread repeatedly entering each loop hole that is formed by the first looper thread, and exiting the loop hole while entwining two opposing threads of two adjacent rings that protrude beyond the other piece of fabric, and then entering a neighboring loop hole, thereby joining the two pieces of fabric in a state where respective edges thereof are connected to each other.

Further, the present invention is a seam structure for fabric, which is a structure for joining two pieces of fabric, wherein on the upper face of one piece of fabric, there extends, along an edge of the fabric, a stitch that is formed as a result of part of a needle thread passing through the fabric to reach a lower face thereof through stitch holes that are provided at regular intervals; on the upper face of the other piece of fabric, there are arrayed, along an edge of the fabric, a plurality of rings that are formed as a result of protrusion of an annular leading end of the needle thread that has passed through the stitch holes of the one piece of fabric and through the lower faces of the two pieces of fabric; and a first looper thread, which runs in a zigzagging manner on the fabric upper faces towards the other piece of fabric so as to entwine two needle threads that pass through the stitch holes of the one piece of fabric, and the rings that protrude beyond the other piece of fabric, are linked as a result of a second looper thread repeatedly entering each loop hole that is formed by the first looper thread, and exiting the loop hole while entwining two opposing threads of two adjacent rings that protrude beyond the other piece of fabric, and then entering a neighboring loop hole, and the edge of one piece of fabric is folded back, thereby joining the two pieces of fabric in a state where the edge of the other piece of fabric overlaps the fold-back portion.

Further, the present invention is a method for sewing fabric, the method including: aligning edges and forming a stitch along the edges while causing a part of a needle thread to run through two vertically superposed pieces of fabric at regular intervals, from above the two pieces of fabric; on the upper face of the upper fabric, forming a loop by running a first looper thread in zigzag towards beyond the edges so as to entwine two needle threads that pass through the stitch holes; on the lower face of the lower fabric, forming a loop by causing an annular leading end of the passed-through needle thread to extend beyond the edge of the fabric; beyond the edges of the pieces of fabric, linking the first looper thread and the needle thread as a result of the second looper thread repeatedly entering, from above, each loop hole that is formed by the first looper thread, exiting the loop hole while entwining two opposing threads of two adjacent loops formed by the needle thread at the bottom of the loop hole, and entering thereupon a neighboring loop hole formed by the first looper thread, to perform over-edge stitching at a position away from the edges of the pieces of fabric; and thereafter, spreading out the two pieces of fabric, to join the two pieces of fabric in a state where the respective edges are connected to each other.

Further, the present invention is a method for sewing fabric, the method including: aligning edges and forming a stitch along the edges while causing a part of a needle thread to run through two vertically superposed pieces of fabric at regular intervals, from above the two pieces of fabric; on the upper face of the upper fabric, forming a loop by running a first looper thread in zigzag towards beyond the edges so as to entwine two needle threads that pass through the stitch holes; on the lower face of the lower fabric, forming a loop by causing an annular leading end of the passed-through needle thread to extend beyond the edge of the fabric; beyond the edges of the pieces of fabric, linking the first looper thread and the needle thread as a result of the second looper thread repeatedly entering, from above, each loop hole that is formed by the first looper thread, exiting the loop hole while entwining two opposing threads of two adjacent loops formed by the needle thread at the bottom of the loop hole, and entering thereupon a neighboring loop hole formed by the first looper thread, to perform over-edge stitching at a position away from the edges of the pieces of fabric; and thereafter, spreading out the two pieces of fabric, to thereby fold back the edge of the one piece of fabric, and join the two pieces of fabric in a state where the edge of the other piece of fabric overlaps the fold-back portion.

Further, the present invention is an overlock sewing machine, in which over-edge stitching is performed through mutual cooperation of: a needle that has, at a tip thereof, a thread hole, into which the needle thread is inserted, and that moves up and down; an upper looper that has, at a tip thereof, a thread hole, into which a first looper thread is inserted, and that operates intersecting a feed direction of the fabric; and lower looper that has, at a tip thereof, a thread hole, into which the second looper thread is inserted, and that operates intersecting the feed direction of the fabric, wherein a position, at which over-edge stitching is performed on a side face of a claw of a needle plate, is disposed outwardly spaced from the edges of the pieces of fabric that are cut by upper and lower knives.

Further, the present invention is a sewing method by an overlock sewing machine, the method including: relaxing the tension of a needle thread to cause a lower looper to carry the annular leading end of the needle thread that has run through two pieces of fabric, to a position outwardly spaced from edges of the pieces of fabric, thereby performing over-edge stitching by the first looper thread, the second looper thread and the needle thread at the position.

Further, the present invention is a sewing method by an overlock sewing machine, the method including: passing a needle thread through a threading hole of a looper thread take-up, such that, when the looper moves, the lower looper carries the annular leading end of the loosened needle thread.

The present invention succeeds in providing a garment that is aesthetically superior and in which pieces of fabric can be sewn together smoothly, without a sewn-on portion protruding at the reverse surface of the garment that comes in contact with the skin, and without fabric edges being exposed at the front surface of the garment.

In the seam structure for fabric of the present invention, the edges at which the two pieces of fabric are joined to each other are not fixed, and can slide. As a result, the fabric slides by tracking of the motion of the skin of a moving individual, and, accordingly, the fabric does not rub against the skin surface. It is therefore easy to move, even with the worn garment. Further, allergic skin is not irritated by the reverse surface of the garment, even when in motion, and discomfort can thus be effectively reduced.

BEST MODE FOR CARRYING OUT THE INVENTION

The seam structure for fabric and sewing method of the present invention will be explained next with reference to accompanying drawings.

Figure 1:
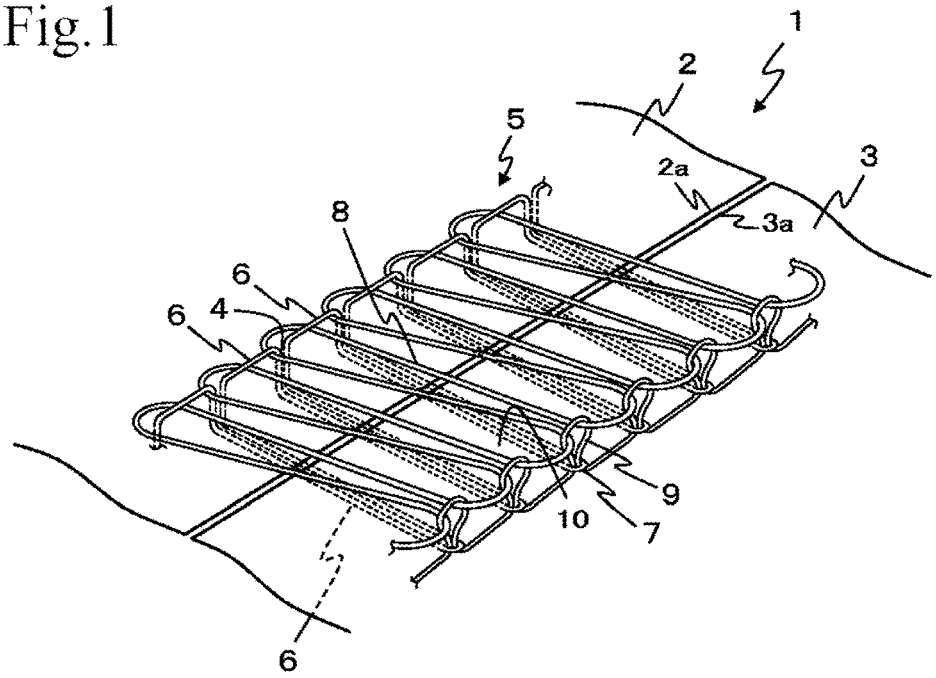
FIG. 1 is a set of diagrams illustrating a seam structure for fabric (FIG. 1(*a*) is a top-view diagram, and FIG. 1(*b*) is a bottom-view diagram)
Figure 1:
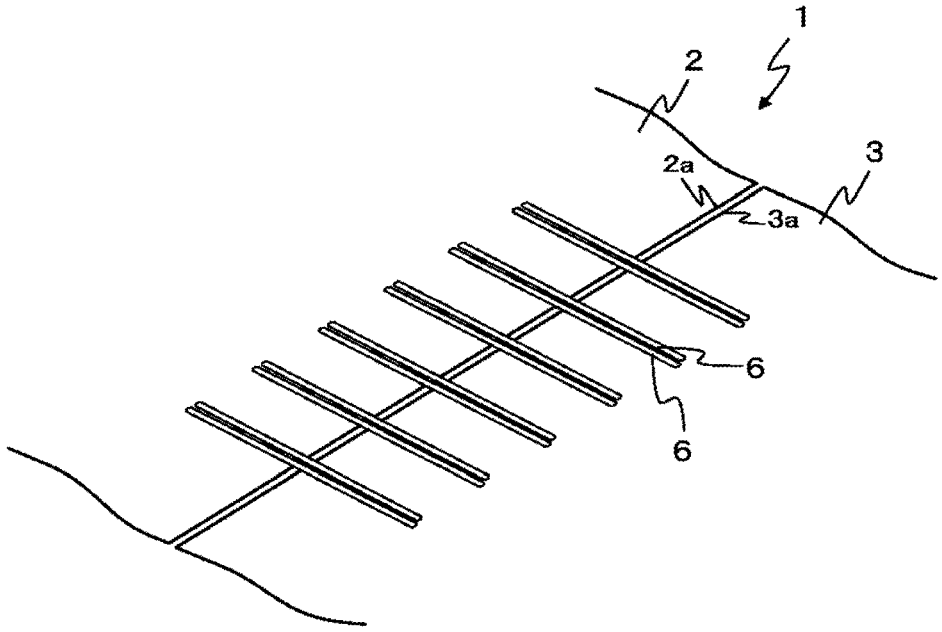

The seam structure for fabric of the present invention is a seam structure for fabric (1) in which edges (2*a*, 3*a*) of two pieces of fabric (2, 3) are joined to each other in a state where latter are connected to each other, as illustrated in FIG. 1(*a*), wherein: on the upper face of one piece of fabric (2) there extends, along the edge (2*a*) of the fabric, a stitch (5) that is formed as a result of a part of a needle thread (6) passing through the fabric to reach a lower face thereof through stitch holes (4) that are provided at regular intervals; on the upper face of the other piece of fabric (3) there are arrayed, along an edge (3*a*) of the fabric, a plurality of rings (7) that are formed as a result of protrusion of an annular leading end of the needle thread (6) having passed through the stitch holes (4) of the one piece of fabric (2) and through the lower faces of the two pieces of fabric (2, 3); and a first looper thread (8), which runs in a zigzagging manner on the fabric upper faces towards the other piece of fabric (3) so as to entwine two needle threads (6) that pass through the stitch holes (4) of the one piece of fabric (2), and the rings (7) that protrude beyond the other piece of fabric (3), are linked as a result of a second looper thread (9) repeatedly entering each loop hole (10) that is formed by the first looper thread (8), and exiting the loop hole (10) while entwining two opposing threads of two adjacent rings (7) that protrude beyond the other piece of fabric (3), and then entering a neighboring loop hole, thereby joining the two pieces of fabric (2, 3) in a state where the respective edges (2*a*, 3*a*) are connected to each other.

By adopting such a seam structure for fabric, it becomes possible to provide a garment that is aesthetically superior and in which pieces of fabric can be sewn together smoothly, without a sewn-on portion protruding at the reverse surface of the garment that comes in contact with the skin, and without fabric edges being exposed at the front surface of the garment.

In order to conventionally sew together two pieces of fabric, for instance in garment sewing, overlock sewing machines are ordinarily used to join the two pieces of fabric while avoiding fraying of fibers at the edges of the pieces of fabric. Generally, two superposed pieces of fabric, with the edges thereof aligned, are over-edge stitched at the edges, using two looper threads, while the pieces of fabric are sewn together using a needle thread (FIG. 11(*a*)). The appearance of the sewn-on portion resulting from such sewing by the overlock sewing machine is poor in that, although fibers are not frayed, the edges of the pieces of fabric are nevertheless still exposed. In consequence, the sewn-on portion is made non-visible from the outside by being arranged on the reverse surface of the garment.

Figure 11:
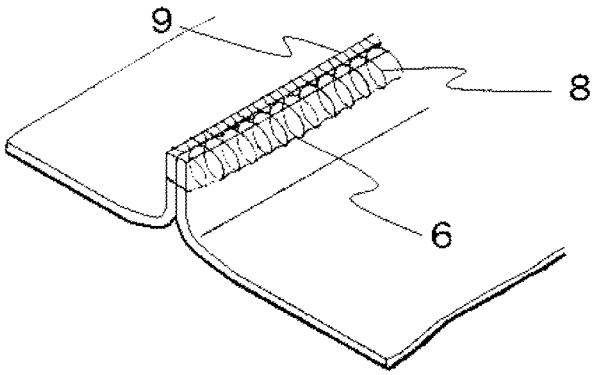
FIG. 11 is a diagram illustrating a seam structure for fabric by a conventional overlock sewing machine (FIG. 11(*a*) is a state in which a sewn portion is upright, and FIG. 11(*b*) is a state in which the sewn portion has been flattened).
Figure 11:
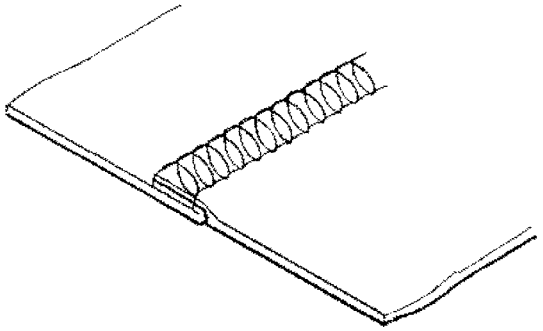

When the sewn-on portion resulting from such sewing by the overlock sewing machine is disposed on the reverse surface of the garment, however, the fabric becomes thicker at the sewn-on portion (FIGS. 11(*a*), 11(*b*)), and the sewn-on portion protrudes beyond the reverse surface of the garment, thereby irritating the skin. In particular, allergic diseases of the skin, for instance atopic dermatitis, have become problematic in recent years. When the skin comes in contact with a garment, the symptoms of such diseases are aggravated due to itching induced by rubbing with the garment.

By joining pieces of fabric according to the seam structure for fabric of the present invention, it becomes possible to provide a garment that is aesthetically superior and in which pieces of fabric can be sewn together smoothly, without a sewn-on portion protruding at the reverse surface of the garment that comes in contact with the skin, and without fabric edges being exposed at the front surface of the garment. The respective edges of the connected two pieces of fabric are not fixed, and can slide. As a result, the fabric slides by tracking of the motion of the skin of a moving individual, and, accordingly, the fabric does not rub against the skin surface. It is therefore easy to move, even with the worn garment. Further, allergic skin is not irritated by the reverse surface of the garment, even when in motion, and discomfort such as itching can thus be effectively reduced.

As illustrated in FIG. 1(*b*), the seam structure for fabric of the present invention is a structure wherein on the lower face of fabric the needle thread (6) is arranged perpendicularly to the respective edges (2*a*, 3*a*) of the two pieces of fabric (2, 3), such that the pieces of fabric are smooth and have not protruding portions, not only on the upper face of the pieces of fabric, but on the lower face as well. The upper face or the lower face of the two pieces of fabric can be disposed on either the front surface or the reverse surface of a garment.

The seam structure for fabric of the present invention can be used to join all manner of fabrics, so long as the latter are, for instance, woven fabrics, knitted fabrics (knit-wear), lace, felt, nonwoven fabrics or the like, without limitations regarding fiber material and knitting or weaving scheme, and also fabrics resulting from processing multiple fibers into a thin and wide plate-like shape.

Figure 2:
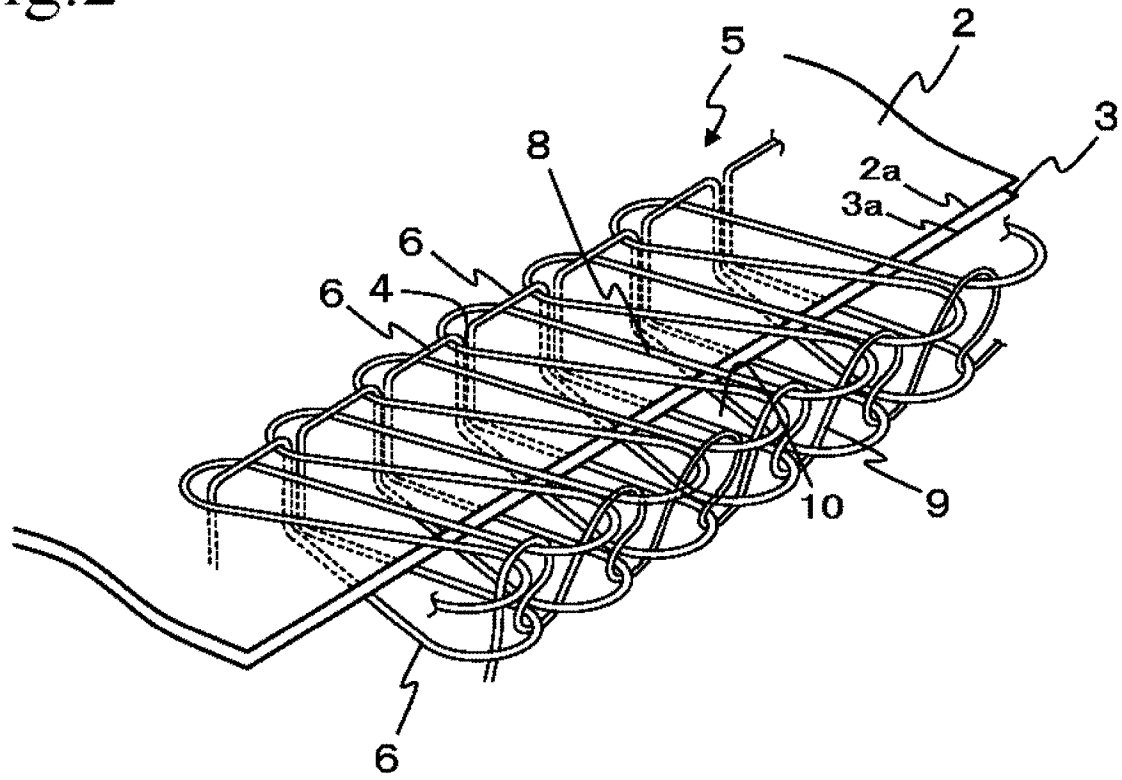
FIG. 2 is a diagram illustrating a state in which two superposed pieces of fabric are being sewn.

In order to form a seam structure for fabric such as the one of FIG. 1 efficiently and with good precision, a sewing method is suitably resorted to that involves vertically superposing two pieces of fabric and sewing the two pieces of fabric together as illustrated in FIG. 2.

Specifically, the method for sewing fabric involves aligning the edges (2*a*, 3*a*) and forming the stitch (5) along the edges (2*a*, 3*a*) while causing part of the needle thread (6) to run through the two vertically superposed pieces of fabric (2, 3) at regular intervals, from above the two pieces of fabric (2, 3); on the upper face of the upper fabric (2), forming a loop by running the first looper thread (8) in zigzag towards beyond the edges, in such a way so as to entwine two needle threads (6) passing through the stitch holes (4); on the lower face of the lower fabric (3), forming a loop by causing an annular leading end of the run-through needle thread (6) to extend beyond the edge of the fabric; beyond the edges (2*a*, 3*a*) of the pieces of fabric, linking the first looper thread (8) and the needle thread (6) as a result of the second looper thread (9) repeatedly entering, from above, a respective loop hole (10) that is formed by the first looper thread (8), exiting the loop hole (10) while entwining two opposing threads of two adjacent loops, formed by the needle thread (6), at the bottom of the loop hole (10), and entering thereupon a neighboring loop hole formed by the first looper thread (8), to perform over-edge stitching at a position away from the edges (2*a*, 3*a*) of the pieces of fabric (2, 3); and thereafter, spreading out the two pieces of fabric (2, 3), to join as a result the two pieces of fabric in a state where the respective edges (2*a*, 3*a*) are connected to each other. This method is optimal by virtue of the high sewing precision afforded by the method, and also the excellent working efficiency of the method.

Figure 3:
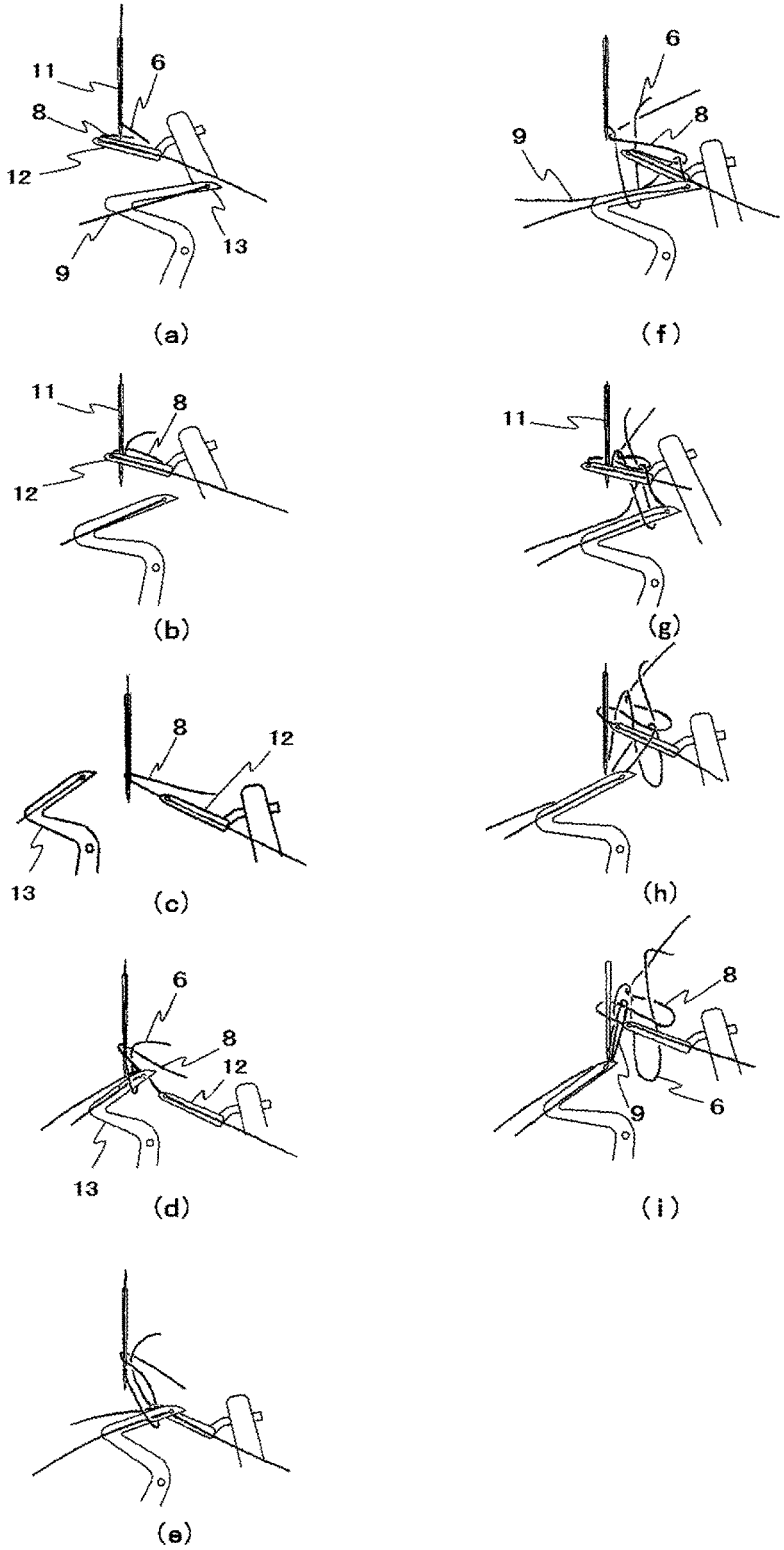
FIG. 3 is set of diagrams illustrating the motion of a needle, an upper looper and a lower looper.
Figure 4:
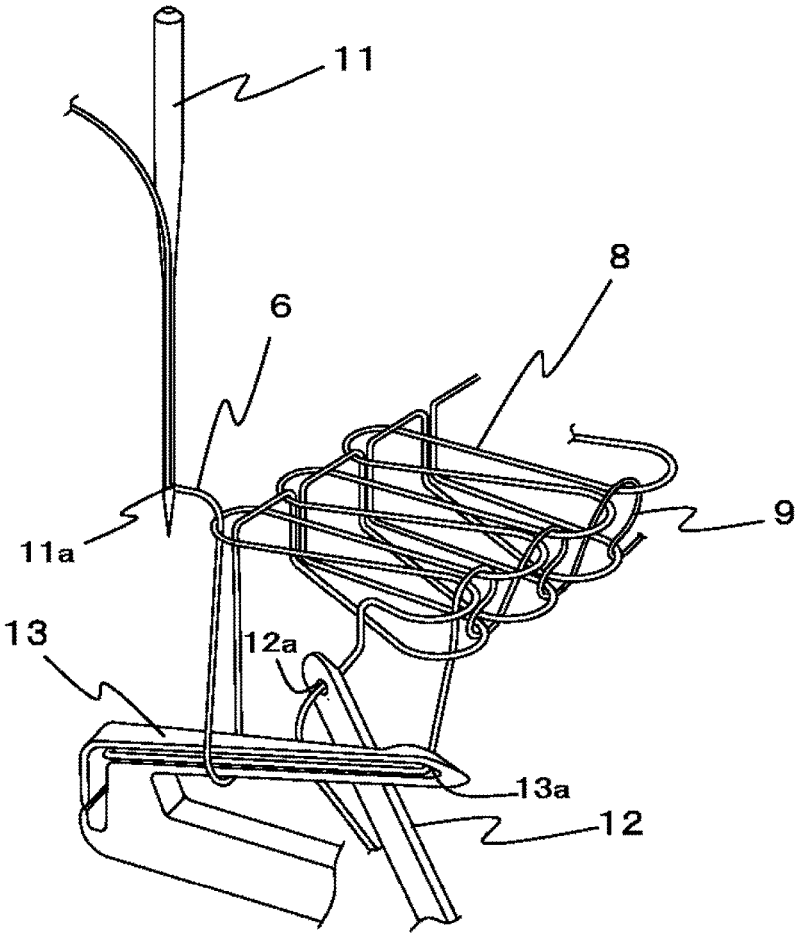
FIG. 4 is a diagram illustrating over-edge stitching by a needle thread, a first looper thread and a second looper thread.

Such a sewing method can be carried out using an overlock sewing machine (see FIGS. 3, 4). The overlock sewing machine is a machine wherein over-edge stitching is performed through mutual cooperation of a needle (11) that moves up and down and that has, at the tip, a thread hole (11*a*) into which the needle thread (6) is inserted, an upper looper (12) that has, at the tip, a thread hole (12*a*) into which the first looper thread (8) is inserted and that operates by intersecting a feed direction of the fabric, and a lower looper (13) that has, at the tip, a thread hole (13*a*) into which the second looper thread (9) is inserted and that operates by intersecting the feed direction of the fabric. FIGS. 3(*a*) to 3(*i*) illustrate a working procedure of the needle (11), the upper looper (12) and the lower looper (13) for performing over-edge stitching by an overlock sewing machine.

(1) In a state where the needle (11) is positioned above the upper looper (12), the latter moves leftward, and becomes disposed below the needle (11) (FIG. 3(*a*)).

(2) The needle (11) moves from top to bottom, and hooks the first looper thread (8) (FIG. 3(*b*)).

(3) The upper looper (12) moves rightward, and the first looper thread (8) is stretched. The needle reaches thereupon a lowest point (FIG. 3(*c*)).

(4) After reaching the lowest point, the needle rises, and the lower looper (13) hooks part of the loosened needle thread (6) (FIG. 3(*d*)).

(5) As the needle (11) ascends, the lower looper (13) moves rightward, and the needle thread (6) is stretched (FIG. 3(*e*)).

(6) Part of the loosened second looper thread (9) is hooked as a result of the upward motion of the upper looper (12) from the bottom (FIG. 3(*f*)).

(7) The upper looper (12) moves leftward, and the needle (11) having descended from above hooks the first looper thread (8) (FIG. 3(*g*)).

(8) The upper looper (12) moves rightward, and the first looper thread (8) is stretched (FIG. 3(*h*)).

(9) When the upper looper (12) moves rightward, the second looper thread (9) leaves the upper looper (12) and becomes entangled with the first looper thread (8) (FIG. 3(*i*)).

Over-edge stitching such as the one illustrated in FIG. 4 can be performed thus by repeating such an operation illustrated in FIGS. 3(*a*) to 3(*i*).

Sewing in overlock sewing machines is ordinarily performed with the needle thread (6) highly taut, but in order to form the seam structure of the present invention, it is pertinent that the lower looper (13) moves rightward while stretching the needle thread (6) smoothly. Preferably, therefore, the overlock sewing machine utilizes a mechanism such that the tension of the needle thread is relaxed when the lower looper (13) moves rightward.

Figure 5:
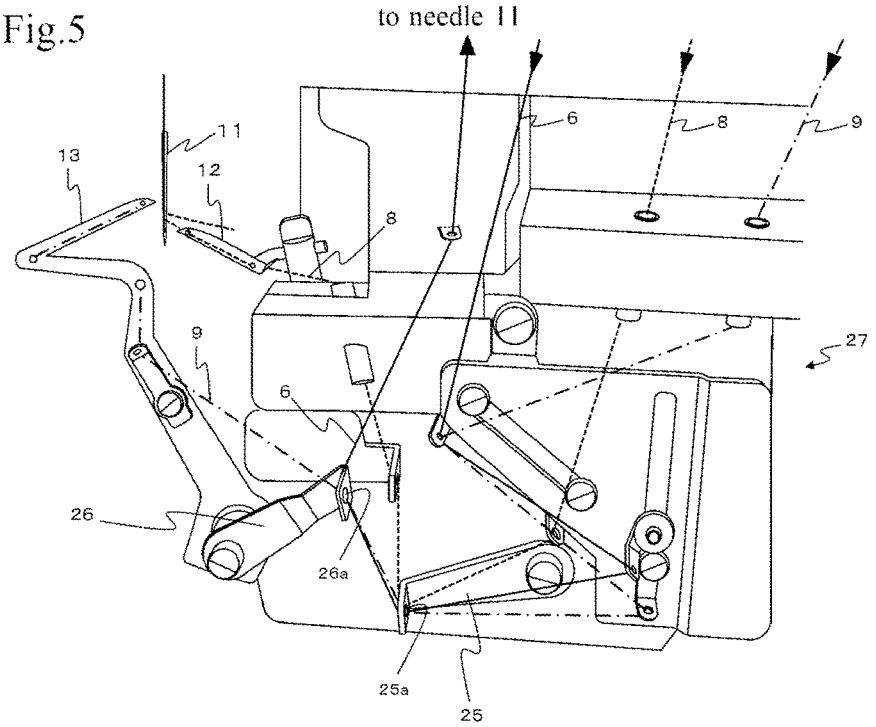
FIG. 5 is a set of diagrams illustrating a first embodiment of the adjustment of the degree of tension of a needle thread (FIG. 5(*a*) is a diagram illustrating a taut thread, and FIG. 5(*b*) is a diagram illustrating a loose thread)
Figure 5:
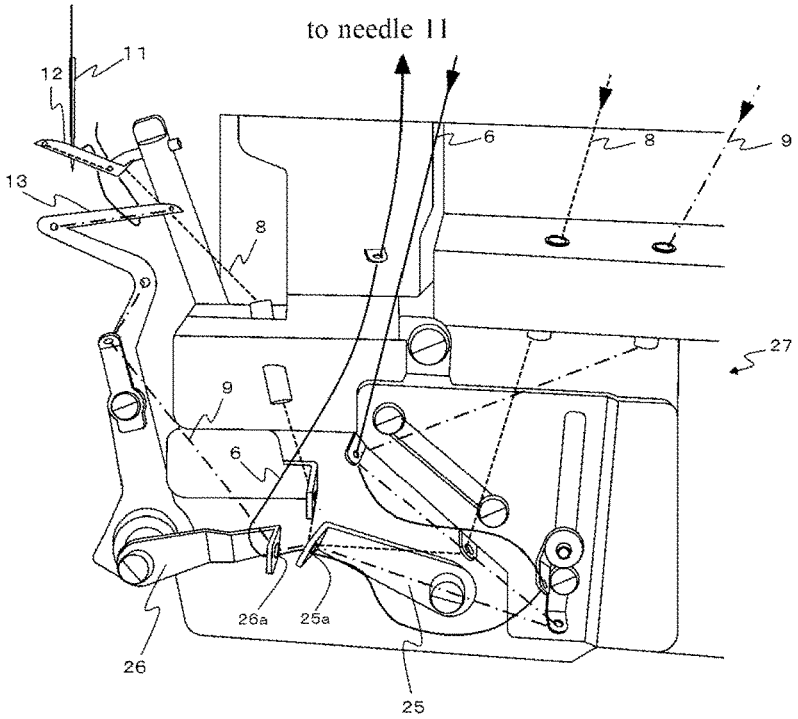

As illustrated in FIG. 5, the overlock sewing machine is provided with an upper looper thread take-up (25)), for smoothly supplying thread to the upper looper (12), and with a lower looper thread take-up (26) for smoothly supplying thread to the lower looper (13). Thread is introduced into the overlock sewing machine, along a thread guide (27), from a bobbin that is disposed above the sewing machine; the first looper thread (8) passes through a threading hole (25*a*) provided at the tip of the upper looper thread take-up (25), and is supplied to the upper looper (12), while the second looper thread (9) passes through a threading hole (26*a*) at the tip of the lower looper thread take-up (26), and is supplied to the lower looper (13).

The upper looper thread take-up (25) rocks in such a manner that the threading hole (25*a*) at the tip moves up and down in response to the motion of the upper looper (12). Specifically, the upper looper thread take-up (25) rocks in such a manner that the threading hole (25*a*) at the tip moves upward when the upper looper (12) moves leftward in the figure, to thereby pay out smoothly the first looper thread (8), and so that the threading hole (25*a*) at the tip moves downward, in such a manner that the first looper thread (8) does not loosen inside the sewing machine, when the upper looper (12) moves rightward. Meanwhile, the lower looper thread take-up (26) rocks in such a manner that the threading hole (26*a*) at the tip moves up and down in response to the motion of the lower looper (13). Specifically, the lower looper thread take-up (26) rocks in such a manner that the threading hole (26*a*) at the tip moves downward, to bring about thereby a state in which the second looper thread (9) is fed smoothly, when the lower looper (13) moves rightward in the figure, and a state in which loosening of the second looper thread (9) is suppressed in the upward motion of the threading hole (26*a*) at the tip, when the lower looper (13) moves leftward.

In order to form the seam structure of the present invention it is pertinent that the lower looper (13) stretches the needle thread (6) rightward smoothly. Relief of the tension of the needle thread (6) when the lower looper (13) moves rightward can be accomplished easily herein, for instance, by causing the needle thread (6), having been guided into the sewing machine along the thread guide, to pass through the threading hole (25*a*) of the upper looper thread take-up (25) and the threading hole (26*a*) of the lower looper thread take-up (FIG. 5).

FIG. 5(*a*) illustrates the state of the upper looper thread take-up (25) and the lower looper thread take-up (26) at a time where the upper looper (12) and the lower looper (13) are spaced apart from each other, as in FIG. 3(*c*). When the needle (11) reaches the lowest point and the upper looper (12) and the lower looper (13) are in a state of being separated from each other, the threading hole (25*a*) of the upper looper thread take-up (25) is positioned at the top and the threading hole (26*a*) of the lower looper thread take-up (26) is positioned at the bottom; as a result, the two threading holes (25*a* and 26*a*) draw apart from each other, and the needle thread (6) is brought to a taut state. From this state (state in FIG. 3(*c*)), the upper looper (12) moves gradually leftward and the lower looper (13) rightward, and the needle thread (6) loosens gradually as a result.

FIG. 5(*b*) illustrates the state of the upper looper thread take-up (25) and the lower looper thread take-up (26) at a time where the upper looper (12) and the lower looper (13) have come close to each other, as in FIG. 3(*g*). Herein the two threading holes (25*a* and 26*a*) draw close to each other, whereby the needle thread (6) is brought to a loosened state. The needle thread (6) loosens thus in response to the motion of the lower looper (13), and, accordingly, the lower looper (13) can move rightward, while smoothly stretching the needle thread (6), without experiencing resistance from the needle thread (6). The seam structure of the present invention can be formed stably as a result.

FIG. 5 illustrates an example in which the needle thread (6) is caused to pass through the threading hole (25*a*) of the upper looper thread take-up (25) and the threading hole (26*a*) of the lower looper thread take-up (26), but any widely used mechanism not limited thereto can also be used, so long as the mechanism eases the tension of the needle thread during the rightward motion of the lower looper (13).

Figure 6:
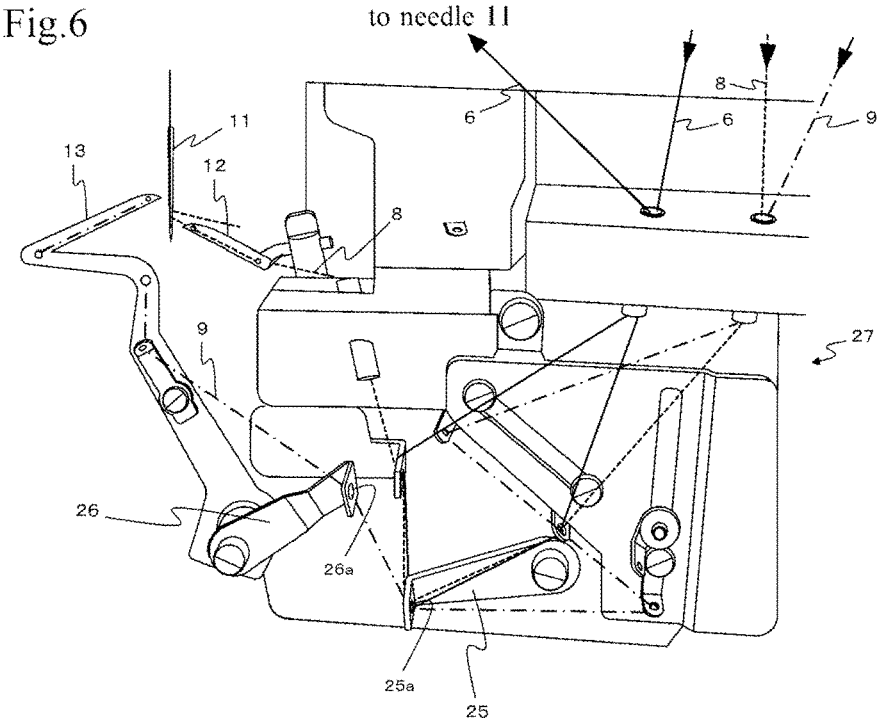
FIG. 6 is a set of diagrams illustrating a second embodiment of the adjustment of the degree of tension of a needle thread (FIG. 6(*a*) is a diagram illustrating a taut thread, and FIG. 6(*b*) is a diagram illustrating a loose thread)
Figure 6:
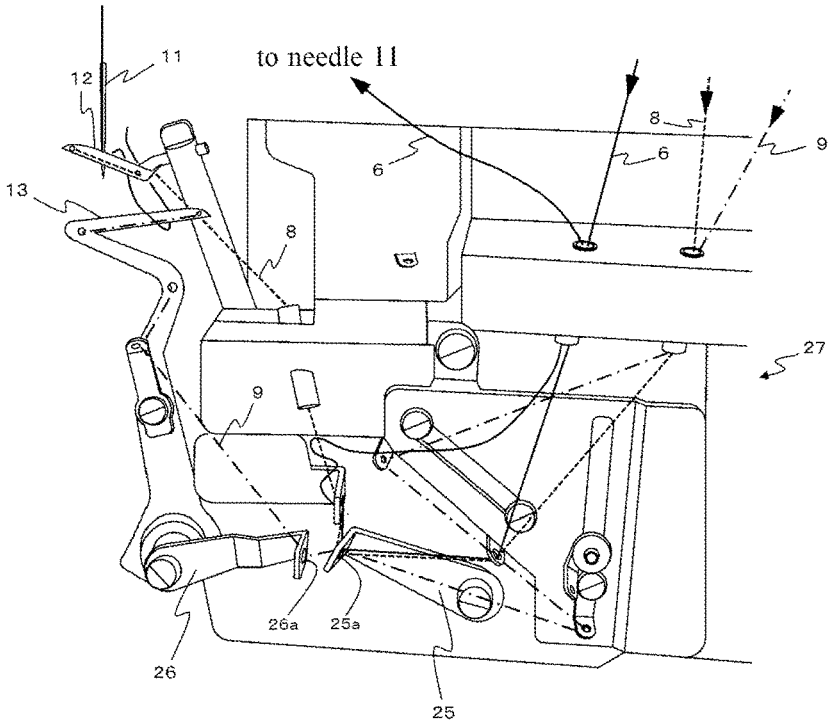

For instance, FIG. 6 illustrates a second embodiment in which the needle thread (6) is not caused to pass through the threading hole (26*a*) of the lower looper thread take-up, but only through the threading hole (25*a*) of the upper looper thread take-up, to adjust thereby the degree of tension of the needle thread. In particular, if the needle thread (6) is wound 1.5 to 2 times on the first looper thread (8), above the vicinity of the threading hole of the upper looper thread take-up, then the needle thread (6) as well is readily made taut along with tensioning of the first looper thread (8), in a state where the threading hole (25*a*) of the upper looper thread take-up has descended, as in FIG. 6(*a*), whereas when the upper looper (12) moves leftward and the first looper thread (8) is pulled up, as in FIG. 6(*b*), the needle thread (6) is pulled up, along with the movement of the first looper thread (8). The needle thread (6) can be loosened effectively as a result.

By causing thus the needle thread to pass through the looper thread take-up that moves up and down in response to the motion of the looper, it becomes possible to effectively loosen the needle thread during motion of the lower looper, and it becomes possible for the lower looper to carry smoothly the annular leading end of the needle thread while stretching the needle thread.

In order to bring the edges to a connected state through spreading of the two pieces of fabric after the latter have been sewn, in a superposed state, in the overlock sewing machine, it is necessary to perform over-edge stitching at a position spaced from the edges (2*a*, 3*a*) of the pieces of fabric (2, 3) being superposed in such a manner that the lower fabric can be spread out. To that end, it is pertinent that in the overlock sewing machine, the position (over-edging position (18)) at which over-edge stitching is performed, on a side face of a claw (16) of a needle plate (15) be disposed outwardly spaced from the edges of the pieces of fabric that are cut by upper and lower knives (19, 20).

Figure 7:
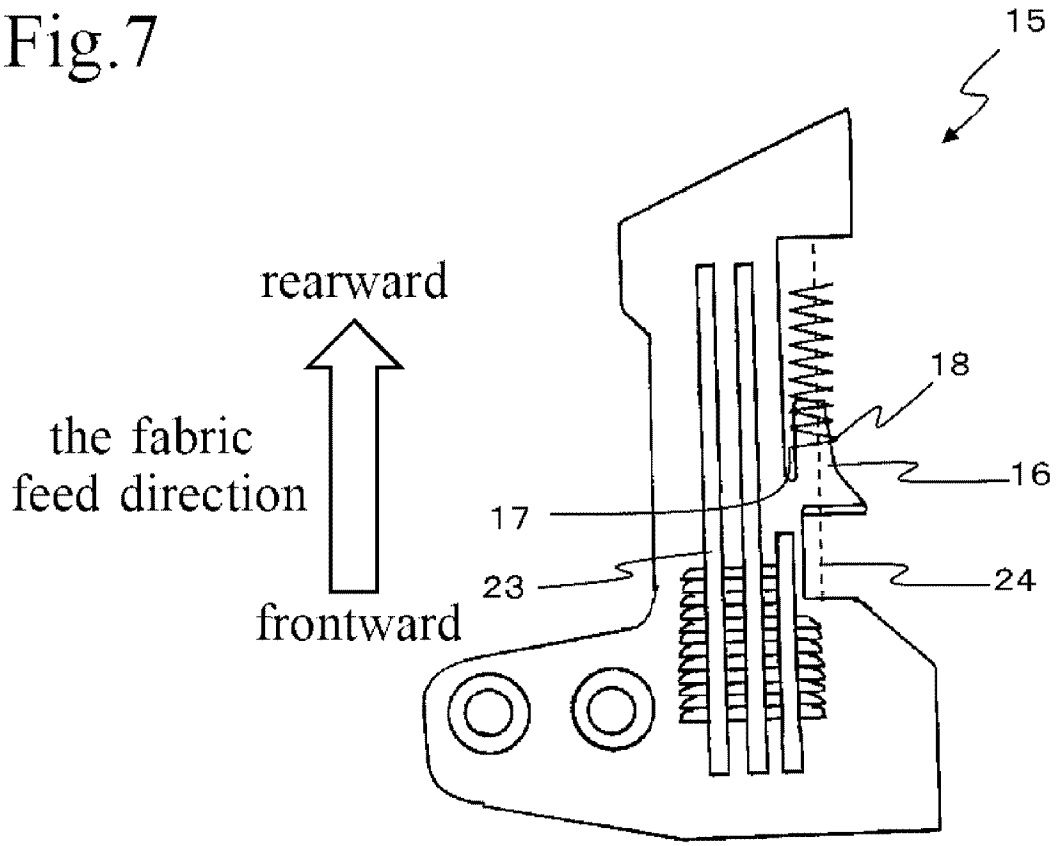
FIG. 7 is a structure diagram of a needle plate that is used in an overlock sewing machine.

FIG. 7 illustrates a structure of a needle plate that is used in an overlock sewing machine. The needle plate (15) is fixed to the frame of the overlock sewing machine, at a site corresponding to the motion of the needle (11). A needle drop section (17) is formed in the needle plate (15), running vertically through the latter, and the claw (16), which is formed integrally with the needle plate (15), extends rearwards, starting at the portion adjacent to the needle drop section (17).

Figure 8:
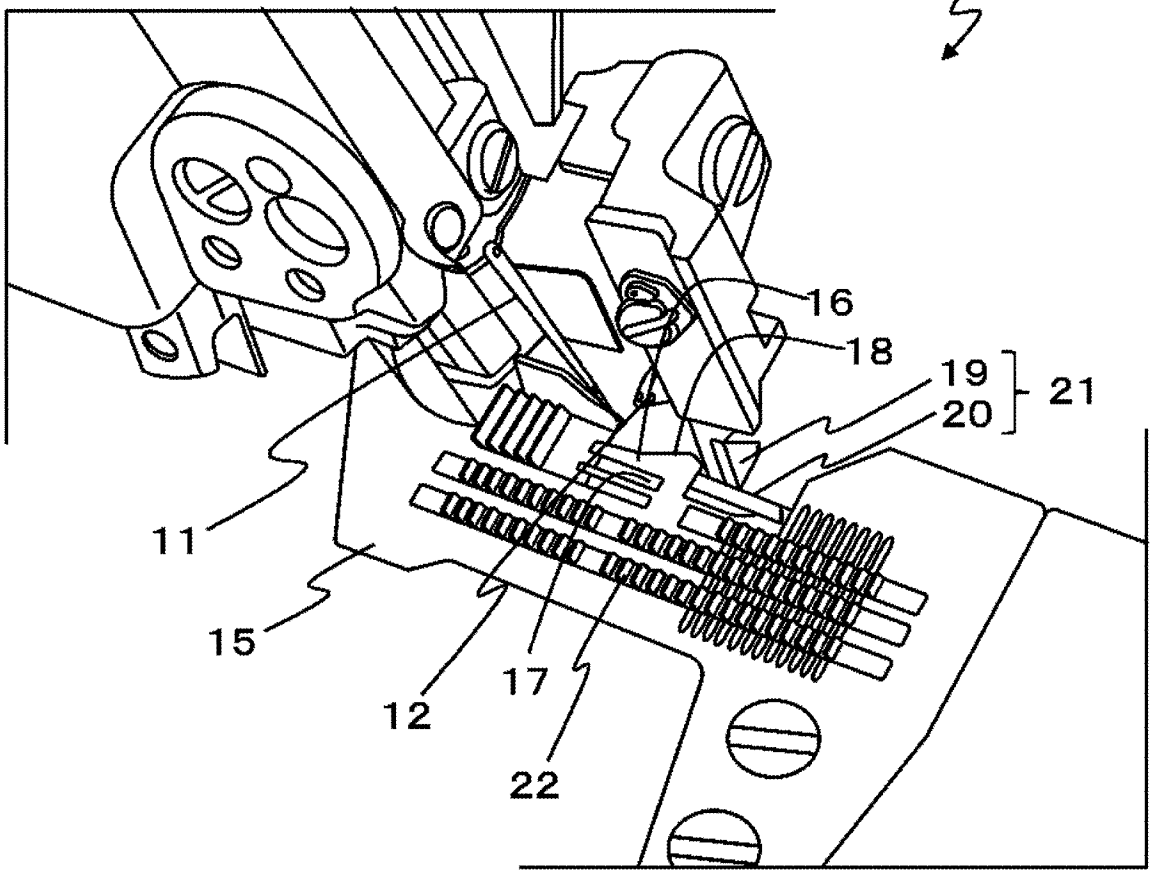
FIG. 8 is a structure diagram of an overlock sewing machine.

Frontward of the claw (16), on the side in front of the needle drop section (17), there is provided a cutting device (21) comprising the lower knife (20) and the upper knife (19) that are vertically movable and fitted to the sewing machine, such that the side edge of the fabric is cut, immediately before sewing, through sliding contact of both knives (19, 20) relatively to each other, which is caused by downward movement of the upper knife (19) (FIG. 8). A holding plate (not shown) is disposed on the upper face of the needle plate (15), such that the fabric can be fed out stably by being sandwiched between the needle plate (15) and the holding plate.

Three rows of long holes (23) are formed, in the needle plate (15), along the fabric feed direction. A fabric-feeding mechanism is configured wherein feed dogs (22) that protrude through the long holes (23) move in the up-and-down and front-rear direction, along the long holes (23), as a result of which the fabric on the needle plate (15) is fed rearward (FIG. 8).

Upon startup of the overlock sewing machine, the side edges of the pieces of fabric are trimmed as a result of the up-and-down motion of the upper knife (19); simultaneously therewith, the leading end of the fabric is fed in, by the feed dogs (22), up to the needle drop section (17), whereupon over-edge stitching is performed at the over-edging position (18), on the side of the claw (16).

Over-edge stitching at a position spaced from the edges (2*a*, 3*a*) of the superposed pieces of fabric (2, 3) can be performed by setting the claw (16) of the needle plate (15) to be wide, and by setting the position (over-edging position (18)), on the side of the claw (16) of the needle plate (15), at which over-edge stitching is carried out, to be outwardly spaced from the edges of the pieces of fabric that are cut by the upper and lower knives (19, 20). The two pieces of fabric are thus sewn, in a superposed state, through over-edge stitching at a position spaced from the edges, such that the lower fabric can be movably spread, and a state be brought about in which the edges are connected to each other, when the two pieces of fabric are spread out thereafter.

The width of the claw (16) of the needle plate (15) is to be adjusted, as appropriate, depending on the tension of the thread and the stiffness of the fabric. However, the edges can be brought to a state of being connected to each other, upon spreading of the two pieces of fabric, by setting the position (over-edging position (18)) on the side of the claw (16) of the needle plate (15), at which over-edge stitching is performed, to be spaced by a distance of about 1 mm beyond the edges (cutting position (24)) of the pieces of fabric that are cut by the upper and lower knives (19, 20).

Figure 9:
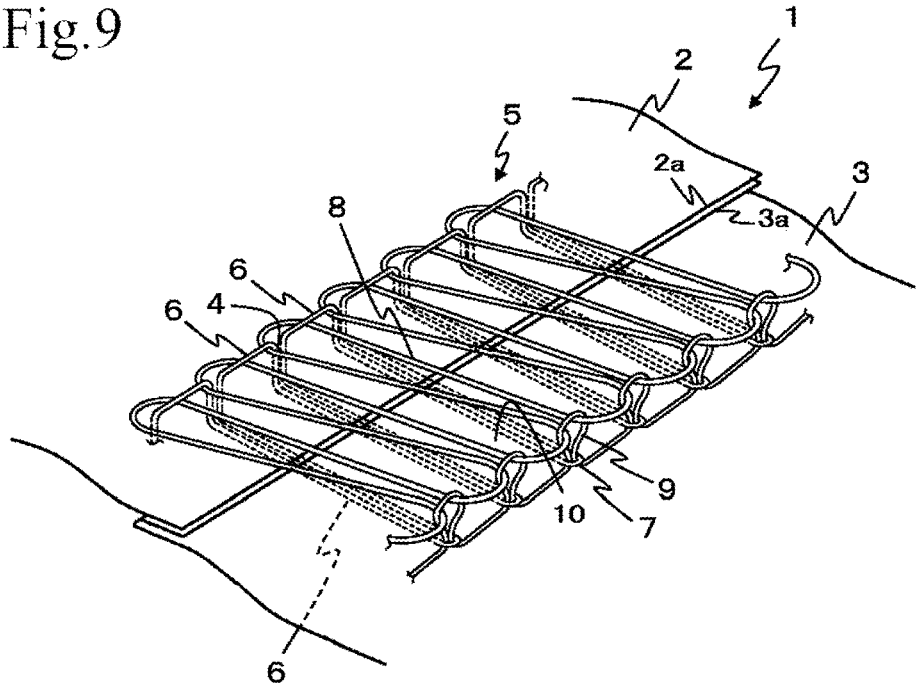
FIG. 9 is a set of diagrams (other embodiment) illustrating a seam structure for fabric (FIG. 9(*a*) is a top-view diagram, and FIG. 9(*b*) is a bottom-view diagram)
Figure 9:
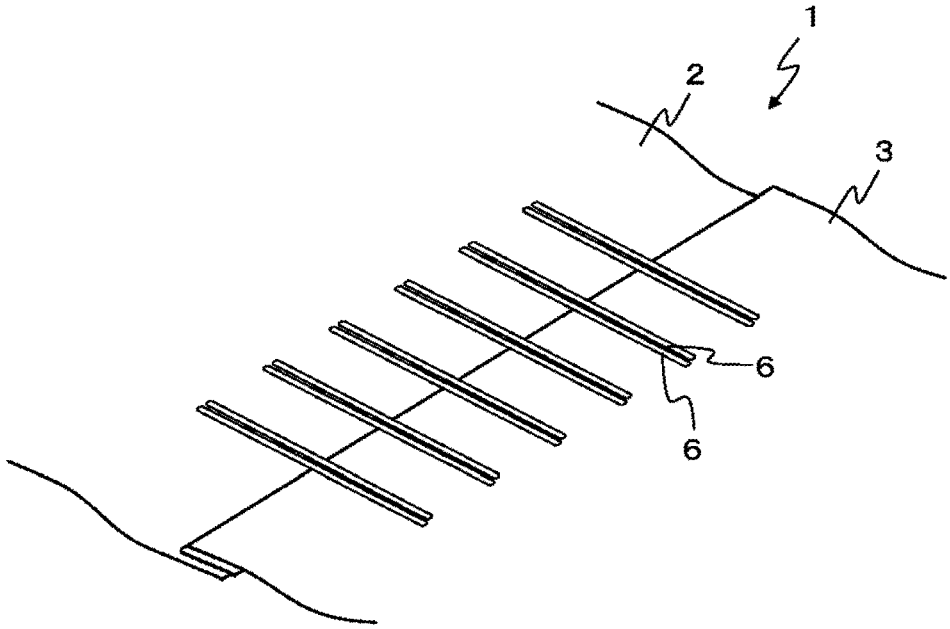

It is also possible, by adjusting the position of the upper and lower knives (19, 20) (by bringing the cutting position (24) and the over-edging position (18) close to each other), to cause only the edge of one of the pieces of fabric to fold back upon spreading of the two pieces of fabric, such that the two pieces of fabric are joined in a state where the edge of the other piece of fabric overlaps the fold-back portion (FIG. 9). Such joining with overlapping edges is preferable in that excellent strength is afforded in that case, and the fabric can be used at garment sites likely to be acted upon by, for instance shoulder line portions, since no gaps occur between the two pieces of fabric even when the latter are stretched left and right. Pressure on the skin can thus be reduced, even with part of the edges in an overlapping state, since the extent by which the sewn portion protrudes is made sufficiently smaller than that in conventional sewing methods (FIGS. 11(*a*), 11(*b*)).

A suitable scheme in order to perform over-edge stitch at position spaced from the edges (2*a*, 3*a*) of the superposed pieces of fabric (2, 3), using the overlock sewing machine, involves relaxing the tension of the needle thread (6); having the lower looper carry the annular leading end of the needle thread that has run through the two pieces of fabric, to a position outwardly spaced from edges of the pieces of fabric; and performing over-edge stitching by the first looper thread, the second looper thread and the needle thread, at a position outwardly spaced from the edges of the pieces of fabric.

As illustrated in FIG. 4, the tension of the needle thread (6) having passed through the needle (11) is eased, so that, as a result, the annular leading end of the needle thread (6) is stretched up to a position outwardly spaced from edges of the pieces of fabric accompanying the motion of the lower looper (13); thereupon, the latter moves rightward in a state of having hooked the needle thread (6), whereupon the annular leading end of the needle thread (6) is over-edged, with the first looper thread (8), by the second looper thread (9). By sewing thus the pieces of fabric with stretching of the needle thread (6), the piece of fabric at the bottom, having been run through by the needle thread (6), can slide over the side face of the needle thread, without experiencing resistance, and can be spread smoothly when the two superposed pieces of fabric are spread out.

Figure 10:
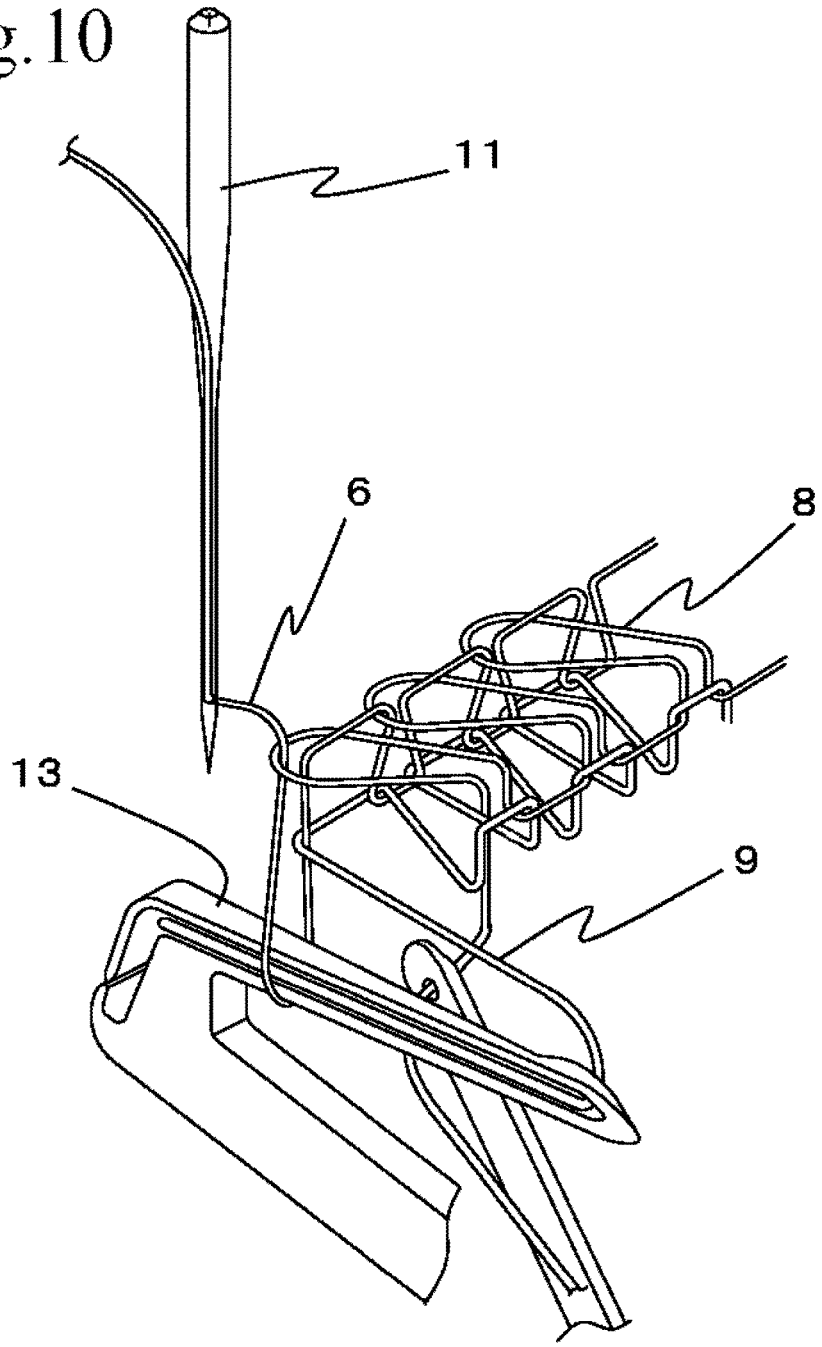
FIG. 10 is a diagram illustrating over-edge stitching by a conventional overlock sewing machine.

The tension of the needle thread (6) in conventional overlock sewing machines is high. Accordingly, the needle thread having been hooked by the moving lower looper (13) is pulled back when coming off the latter, and the needle is disposed, in a zigzagging manner, on the vertical plane within which the needle moves up and down (FIG. 10). The needle thread, being thus disposed in a zigzagging manner, is over-edged by the first looper thread, at the top, and by the second looper thread, at the bottom; as a result, the two superposed pieces of fabric cannot be spread out, to the left and right, due to presence of the over-edged portion, when attempting to spread out the pieces of fabric (FIG. 10)).

EXPLANATION OF REFERENCE NUMERALS

1 seam structure for fabric
2 fabric
2*a* edge
3 fabric
3*a* edge
4 stitch hole
5 stitch
6 needle thread
7 ring
8 first looper thread
9 second looper thread
10 loop hole
11 needle
11*a* thread hole
12 upper looper
12*a* thread hole
13 lower looper
13*a* thread hole
14 overlock sewing machine
15 needle plate
16 claw
17 needle drop section
18 over-edging position
19 upper knife
20 lower knife
21 cutting device
22 feed dog
23 long hole
24 cutting position
25 upper looper thread take-up
25*a* threading hole
26 lower looper thread take-up
26*a* threading hole
27 thread guide

The invention claimed is:

1. A method for sewing two pieces of fabric using an overlock sewing machine in which over-edge stitching is performed through mutual cooperation of: a needle that has, at a tip thereof, a thread hole, into which a needle thread is inserted, and that moves up and down; an upper looper that has, at a tip thereof, a thread hole, into which a first looper thread is inserted, and that operates intersecting a feed direction of the fabric; and a lower looper that has, at a tip thereof, a thread hole, into which a second looper thread is inserted, and that operates intersecting the feed direction of the fabric, wherein a position, at which the over-edge stitching is performed on a side face of a claw of a needle plate, is disposed outwardly spaced from edges of the two pieces of fabric that are cut by upper and lower knives, the method comprising:

aligning the edges and forming a stitch along the edges while causing a part of the needle thread to run through, at regular intervals, the two pieces of fabric vertically superposed to each other, from above the two pieces of fabric;

on an upper face of one piece of the fabric, forming a loop by running the first looper thread in zigzag towards beyond the edges so as to entwine two needle threads that pass through stitch holes;

on a lower face of another piece of the fabric, forming a loop by causing an annular leading end of the passed-through needle thread to extend beyond the edge of the fabric;

beyond the edges of the two pieces of fabric, linking the first looper thread and the needle thread as a result of the second looper thread repeatedly entering, from above, each loop hole that is formed by the first looper thread, exiting the loop hole while entwining two opposing threads of two adjacent loops formed by the needle thread at the bottom of the loop hole, and entering thereupon a neighboring loop hole formed by the first looper thread, to perform over-edge stitching at a position away from the edges of the two pieces of fabric; and thereafter;

spreading out the two pieces of fabric, to i) join the two pieces of fabric in a state where the respective edges are connected to each other, or ii) thereby fold back the edge of the one piece of fabric, and join the two pieces of fabric in a state where the edge of the other piece of fabric overlaps the fold-back portion;

relaxing a tension of the needle thread to cause the lower looper to carry the annular leading end of the needle thread that has run through the two pieces of fabric, to a position outwardly spaced from edges of the two pieces of fabric, thereby performing over-edge stitching by the first looper thread, the second looper thread and the needle thread at the position; and passing the needle thread through the threading hole of a looper thread take-up, such that, when the lower looper moves, the lower looper carries the annular leading end of the loosened needle thread.

* * * * *